US006734397B2

(12) United States Patent
Kato et al.

(10) Patent No.: US 6,734,397 B2
(45) Date of Patent: May 11, 2004

(54) HEATER HAVING AT LEAST ONE CYCLE PATH RESISTOR AND IMAGE HEATING APPARATUS THEREIN

(75) Inventors: Akira Kato, Shizuoka (JP); Yoji Tomoyuki, Tokyo (JP); Yusuke Nakazono, Shizuoka (JP); Kenichi Ogawa, Shizuoka (JP); Hiroyuki Sakakibara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/417,133

(22) Filed: Apr. 17, 2003

(65) Prior Publication Data

US 2003/0196999 A1 Oct. 23, 2003

(30) Foreign Application Priority Data

Apr. 22, 2002 (JP) ..... 2002-119295
Apr. 8, 2003 (JP) ..... 2003-103936

(51) Int. Cl.[7] ..... H05B 1/00; G03G 15/20
(52) U.S. Cl. ..... 219/216; 219/543; 399/329
(58) Field of Search ..... 219/216, 388, 219/543, 478, 479, 476, 539; 338/293, 306, 307, 308, 309; 399/329

(56) References Cited

U.S. PATENT DOCUMENTS 3,965,330 A * 6/1976 Williams ..... 347/210
4,970,219 A 11/1990 Effland et al.
5,138,390 A 8/1992 Miyabayashi et al.
5,253,024 A 10/1993 Okuda et al.
5,293,202 A 3/1994 Adachi et al.
5,338,919 A * 8/1994 Tagashira et al. ..... 219/543
5,365,314 A 11/1994 Okuda et al.
5,391,861 A * 2/1995 Ooyama et al. ..... 219/543
5,444,521 A 8/1995 Tomoyuki et al.
5,464,964 A 11/1995 Okuda et al.
5,471,288 A 11/1995 Ohtsuka et al.
5,525,775 A 6/1996 Setoriyama et al.
5,534,987 A 7/1996 Ohtsuka et al.
5,552,582 A 9/1996 Abe et al.
5,552,874 A 9/1996 Ohtsuka et al.
5,575,942 A * 11/1996 Watanabe ..... 219/469
5,592,276 A 1/1997 Ohtsuka et al.
5,852,763 A 12/1998 Okuda et al.
5,862,445 A 1/1999 Ogawa et al.
5,920,757 A * 7/1999 Izawa et al. ..... 399/329
6,040,558 A * 3/2000 Yamazaki ..... 219/216
6,094,559 A 7/2000 Otsuka et al.
6,175,699 B1 1/2001 Kato et al.

(List continued on next page.)

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 04-204980 | 7/1992 |
| JP | 8-95404 | 4/1996 |
| JP | 9-80969 | 3/1997 |
| JP | 10-104977 | 4/1998 |
| JP | 2002-91229 | 3/2002 |

*Primary Examiner*—Joseph Pelham
*Assistant Examiner*—Vinod D. Patel
(74) *Attorney, Agent, or Firm*—Fitzpatrick, Cella, Harper & Scinto

(57) ABSTRACT

A heater, or an image heating apparatus including the heater includes a substrate, heat generating resistors formed at least in a cycle path on the substrate, and current supply electrodes provided at electrical ends of the heat generating resistors, wherein plural heat generating resistors are connected in parallel to at least one of the current supply electrodes. Thus there can be obtained a heater having excellent heat generating characteristics even in a compact dimension and an image heating apparatus utilizing such heater.

13 Claims, 13 Drawing Sheets

U.S. PATENT DOCUMENTS 6,185,383 B1 * 2/2001 Kanari et al. ..... 399/45
6,259,073 B1 * 7/2001 Inukai ..... 219/497
6,271,873 B1 * 8/2001 Sambongi ..... 347/208
6,323,460 B1 * 11/2001 Ohtsuka ..... 219/216
6,357,863 B1 * 3/2002 Anderson et al. ..... 347/58
6,407,366 B2 * 6/2002 Yoshimura ..... 219/216
6,459,878 B1 10/2002 Tomoyuki et al.
6,516,166 B2 2/2003 Sakakibara et al.
6,548,787 B2 * 4/2003 Natsuhara et al. ..... 219/216
2002/0127035 A1 9/2002 Otsuka et al.
2003/0002895 A1 1/2003 Kato et al.
2003/0077092 A1 4/2003 Ogawa et al.

* cited by examiner

HEATER HAVING AT LEAST ONE CYCLE PATH RESISTOR AND IMAGE HEATING APPARATUS THEREIN

BACKGROUND OF THE INVENTION

1. Field of the Invention

The present invention relates to a heater adapted for use in a heat fixing device to be mounted on an image forming apparatus utilizing electrophotographic or electrostatic recording method, such as a printer or a copying machine, and an image heating apparatus utilizing such heater, and more particularly to a heater having at least one cycle path of a heat generating resistor on a substrate and an image heating apparatus utilizing such heater.

2. Related Background Art

There will be explained an example in which a conventional heating apparatus is applied as an image heating apparatus (fixing apparatus) for heat fixing a toner image to a recording material, provided in an image forming apparatus such as a copying machine or a printer.

In an image forming apparatus, there has been widely employed a heating apparatus of heat roller type, as a fixing apparatus for heat fixing an unfixed image (toner image) of image information, which is formed in suitable image forming process means utilizing an electrophotographic process, an electrostatic recording process or a magnetic recording process, and borne on a recording material (transfer sheet, electrofax sheet, electrostatic recording paper, OHP sheet, printing paper, formatted paper etc.) by a transfer process or a direct process.

Recently, there is commercialized a heating apparatus of film heating type from the standpoint of quick starting or energy saving. The heating apparatus of such film heating type is proposed for example in Japanese Patent Application Laid-open Nos. 63-313182, 2-157878, 4-44075 and 4-204980.

In the heating apparatus of such film heating type, as shown in FIG. 12, a film (rotary member) 25 contains therein a heating member generally formed by a ceramic heater 20 (hereinafter also called a heater or a heating member), while a pressure roller 26 constituting another rotary member pressed to the film 25 is supported by an unrepresented support member, and the heater 20 and the rotary member 26 are pressed by pressurizing means (not shown) to form a pressed nip N. The heater 20 is composed of a heat-resistant base member 20*a* (hereinafter called heater substrate) and a heat generating resistance member 20*b* (also called resistor pattern) formed thereon by a thick film printing, and, on a sliding surface of the heater corresponding to the pressed nip N, there is provided a slidable member having a pressure resistance, a heat resistance and a low friction such as a glass coat layer 20*c*.

FIGS. 13A and 13B show a position relationship of the heat generating resistor 20*b* in a plane of the heater 20. A heater shown in FIG. 13A has one cycle path (double path) of a heat generating resistor 20*b* on the heater substrate 20*a*. A forward path (forward side; ex. right side to left side) (half path) and a return path (return side; ex. left side to right side) (half pass) have a same resistance. Two current supply electrode patterns 20*d*, 20*e* are respectively connected electrically to ends of two heat generating resistors 20*b* of forward side and return side. A connecting electrode pattern 20*f* is provided for electrically connecting the other ends of the above-mentioned two heat generating resistors 20*b* of forward side and return side. Thus, the first current supply electrode pattern 20*d*, one (forward) heat generating resistor 20*b*, the connecting electrode pattern 20*f*, the other (return) heat generating resistor 20*b* and the second current supply electrode pattern 20*e* are electrically connected in series. An electric current is supplied between the first and second current supply electrode patterns 20*d*, 20*e* to generate heat from the two heat generating resistors 20*b* of forward side and return side.

Otherwise, the two heat generating members 20*b* of forward side and return side are given different resistances as shown in FIG. 13B to form a heat generating ratio between the upstream side and the downstream side, thereby varying heat distribution in the nip and optimizing the heat supply to the recording material.

Between such heater 20 and the pressure roller 26 constituting a pressurizing member, there is pinched a heat-resistant film 25 (also called a fixing film, or a fixing belt film) to constitute a pressurized nip N (also called a heating nip or a fixing nip), and the fixing film 25 and the pressure roller 26 are maintained in rotary motion. There are shown a rotating direction R25 of the fixing film 25, a rotating direction R26 of the pressure roller 26, and a conveying direction K of a recording material P.

Between the fixing film 25 and the pressure roller 26 in the pressed nip N, a recording material bearing an unfixed toner image to be fixed is introduced and conveyed together with the fixing film 25, whereby the heat of the ceramic heater 20 is given, in the pressed nip N, to the recording material P across the fixing film 25, and the unfixed toner image T is fixed to the recording material P by heat and pressure, under the pressure of the pressed nip N. In recent years, a further cost reduction is requested for the image forming apparatus including a copying machine and a printer. For such cost reduction, the size of the heater substrate 20*a* has been reduced thereby increasing the number of the heater substrates 20*a* obtained by cutting a single ceramic sheet, but the width of such substrate is now already reduced to several millimeters so that a further increase in the number of the heater substrates cut from a ceramic sheet does not contribute much to the cost reduction.

Also a smaller size of the heater substrate 20*a* decreases the nip N, whereby it becomes difficult to secure the fixing ability.

It is therefore conceivable, for securing the satisfactory fixing property even with a smaller width of the heater substrate, to increase an area of the heat generating resistors in the heater substrate as shown in FIGS. 13A and 13B, thereby effectively utilizing the size of the substrate.

However, in case the heat generating resistor is made wider (larger) as shown in FIGS. 13A and 13B, a resistance per a unit length becomes smaller for a same material of the heat generating resistor, whereby a designed resistance cannot be obtained in the entire heat generating resistor and the amount of heat generation becomes deficient. Consequently, in case of making the heat generating resistor wider, it is necessary to change a material constituting the heat generating resistor, in order to secure the resistance per unit length. The material for the heat generating resistor is principally constituted by silver and palladium (Ag/Pd), and a content of palladium has to be increased in order to increase the resistance. However, palladium is expensive, and an increase in the content thereof leads to a cost increase of the heater.

SUMMARY OF THE INVENTION

In consideration of the foregoing, an object of the present invention is to provide a heater having excellent heat generating characteristics even in a small size and an image heating apparatus utilizing such heater.

Another object of the present invention is to provide a heater of a low cost and an image heating apparatus utilizing such heater.

Still another object of the present invention is to provide a heater, including:

a substrate;

a heat generating resistor formed in at least a cycle path on the substrate; and current supply electrodes provided at electrical ends of the heat generating resistor;

wherein a plurality of the heat generating resistors are connected in parallel to at least one of the current supply electrodes.

Still another object of the present invention is to provide an image heating apparatus including:

a heater, the heater including a substrate, a heat generating resistor formed in at least a cycle path on the substrate, and current supply electrodes provided at electrical ends of the heat generating resistor; and a flexible sleeve rotating in a sliding contact with the heater;

wherein a plurality of the heat generating resistors are connected in parallel to at least one of the current supply electrodes.

Still another object of the present invention is to provide a heater, including:

a substrate;

a heat generating resistor formed on the substrate and including a serial connection of plural resistors of different resistances in at least two cycle paths.

Still another object of the present invention is to provide an image heating apparatus including:

a heater, the heater including a substrate, a heat generating resistor formed on the substrate and containing a serial connection of plural resistors of different resistances in at least two cycle paths, and current supply electrodes provided at electrical ends of the heat generating resistor; and a flexible sleeve rotating in a sliding contact with the heater.

Still other objects of the present invention will become fully apparent from a following detailed description which is to be taken in conjunction with the accompanying drawings.

DESCRIPTION OF THE PREFERRED EMBODIMENTS

In the following there will be explained an embodiment of the present invention.

First Embodiment

A heating apparatus of the present embodiment is an image heat fixing apparatus of film heating type, which employs a fixing film (hereinafter also called a fixing belt or a flexible sleeve) and in which a pressure roller is driven.

Figure 1:
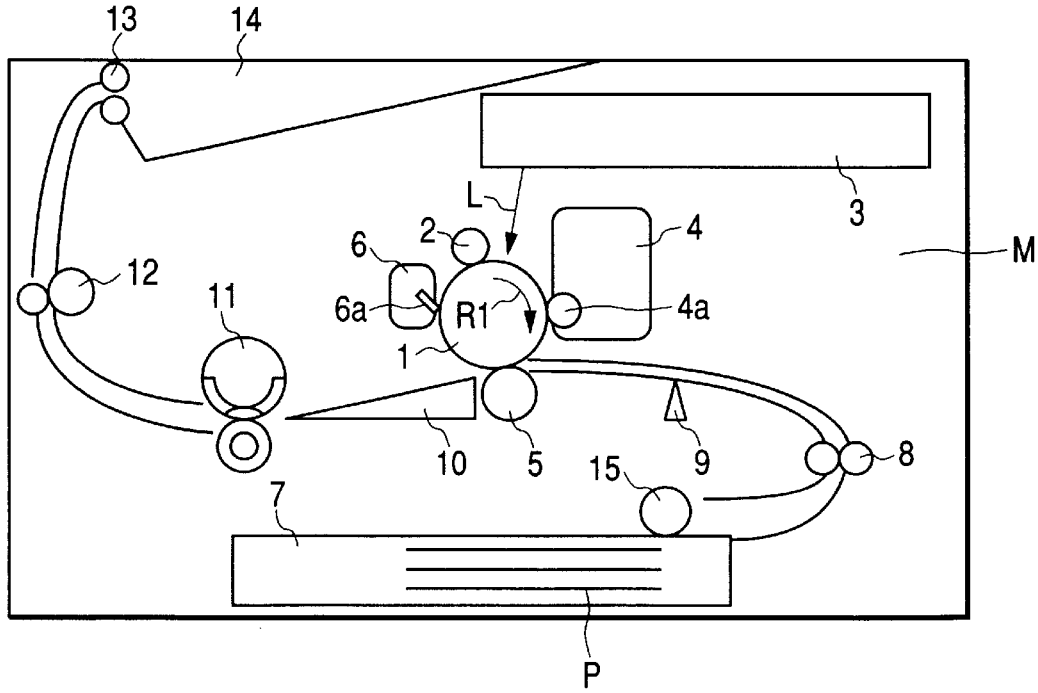
FIG. 1 is a vertical cross-sectional view showing the schematic configuration of an image forming apparatus incorporating an image heating apparatus of the present invention.

FIG. 1 is a vertical cross-sectional view showing the schematic configuration of a laser beam printer (hereinafter called "image forming apparatus") in which an image heating apparatus of the present invention is incorporated.

1) Schematic Configuration of Image Forming Apparatus

The laser beam printer is provided with an electrophotographic photosensitive member 1 of drum type (hereinafter called "photosensitive drum"), as an image bearing member. The photosensitive drum 1 is rotatably supported in a main body M of the apparatus, and is rotated by drive means (not shown) at a predetermined process speed in a direction indicated by an arrow R1.

Around the photosensitive drum 1 and along the rotation direction thereof, there are provided a charging roller (charging apparatus) 2, exposure means 3, a developing apparatus 4, a transfer roller (transfer apparatus) 5, and a cleaning apparatus 6.

In a lower part of the main body M of the apparatus, a sheet cassette 7 containing a sheet-shaped recording material P such as paper is provided, and, along a conveying path of the recording material P and in succession from an upstream side thereof, there are provided a sheet feed roller 15, conveying rollers 8, a top sensor 9, a conveying guide 10, a fixing apparatus 11 constituted by a heating apparatus of the present invention, conveying rollers 12, discharge rollers 13 and a sheet discharge tray 14.

In the following, there will be explained functions of the image forming apparatus of the above-described configuration.

The photosensitive drum 1, rotated in a direction R1 by the drive means (not shown), is uniformly charged to a predetermined polarity and a predetermined potential by the charging roller 2. The surface of the photosensitive drum 1 after charging is subjected to an image exposure L based on image information, by the exposure means 3 such as a laser optical system, whereby the charge in an exposed portion is eliminated to form an electrostatic latent image.

The electrostatic latent image is developed by the developing apparatus 4. The developing apparatus 4 is provided with a developing roller 4*a*, and toner is deposited onto the electrostatic latent image on the photosensitive drum 1 by applying a developing bias to the developing roller 4*a* thereby forming a toner image (visualization).

The toner image is transferred onto the recording material P such as paper by the transfer roller 5. The recording material P is contained in the sheet cassette 7, then fed and conveyed by the feed roller 15 and the conveying rollers 8 and supplied, through the top sensor 9, to a transfer nip between the photosensitive drum 1 and the transfer roller 5. In this operation, the recording material P is, by a sheet top detection by the top sensor 9, synchronized with the toner image on the photosensitive drum 1. A transfer bias is applied to the transfer roller 5, whereby the toner image on the photosensitive drum 1 is transferred onto a predetermined position on the recording material P.

The recording material P, bearing a transferred unfixed toner image on the surface, is conveyed along the conveying guide 10 to the fixing apparatus 11, in which the unfixed toner image is heated and pressurized, thus being fixed to the surface of the recording material P. The fixing apparatus 11 will be explained later in more details. The recording material P after the fixation of the toner image is conveyed and discharged by the conveying roller 12 and the discharge rollers 13 onto the sheet discharge tray 14 on an upper surface of the main body M of the apparatus.

On the other hand, the toner not transferred to the recording material P but remaining on the photosensitive drum (hereinafter called "transfer residual toner") is removed by a cleaning blade 6*a* of the cleaning apparatus 6, and whereby a preparation for a next image formation is made. Image formation can be executed in succession by repeating the above-described operations.

2) Fixing Apparatus 11

In the following, there will be given a detailed explanation, with reference to FIG. 2, on an example of the fixing apparatus 11 constituting the heating apparatus of the present invention. An arrow K indicates the conveying direction of the recording material P.

Figure 2:
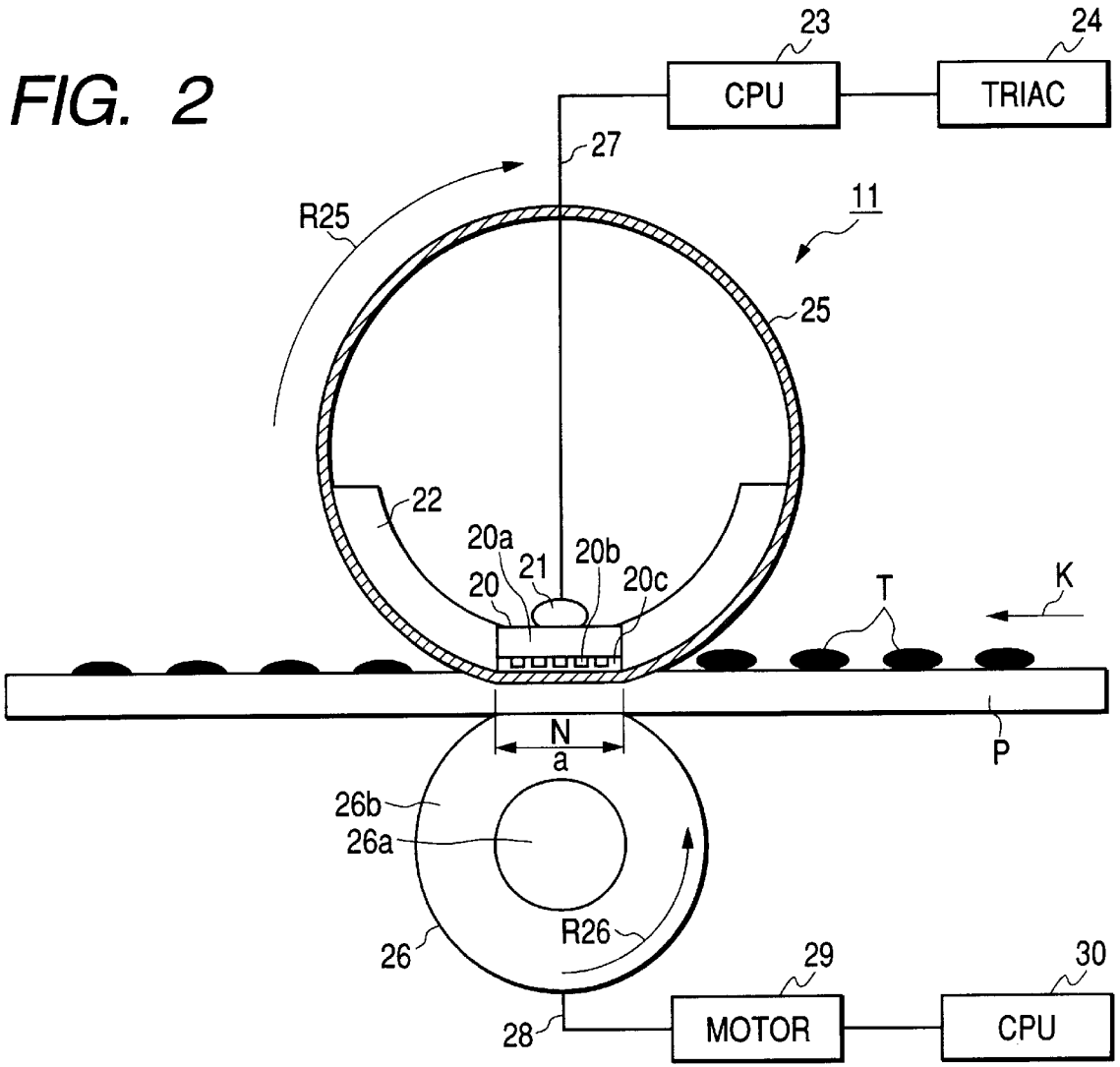
FIG. 2 is a vertical cross-sectional view showing the schematic configuration of a fixing apparatus embodying the present invention.

The fixing apparatus 11 shown in FIG. 2 is principally formed by a ceramic heater 20 serving as a heating member for heating toner, a fixing film (fixing rotary member) 25 surrounding the heater 20, a pressure roller 26 which forms a nip N with the heater 20 across the fixing film 25, temperature control means 27 which controls the temperature of the heater 20, and rotation control means 28 which controls the conveying of the recording material P.

The heater 20 includes a heat-resistant base member (substrate) 20*a* for example of alumina or aluminum nitride (AlN), a heat generating resistor 20*b* formed for example by thick film printing on the base member, and a glass coat layer (surface layer) 20*c* formed so as to cover the heat generating resistor and serving as a heater sliding part having a pressure resistance, a heat resistance and a low friction, corresponding to the nip N. The heater 20 is supported by a heater holder 22 mounted on the main body M of the apparatus, and the heater holder 22 is formed into a semicircular shape by a heat-resistant resin and serves also as a guide member for guiding the rotation of the fixing film 25.

The fixing film 25 is formed in a cylindrical shape by heat-resistant resin such as polyamide, and the aforementioned heater 20 and the heater holder 22 are positioned inside the cylinder. The fixing film 25 is pressed to the heater 20 by the pressure roller 26 to be explained later, whereby a rear surface of the fixing film 25 is in contact with a lower surface of the heater 20.

The fixing film 25 is so constructed as to be driven in rotation in a direction R25, by the rotation of the pressure roller 26 in the direction R26, along with the conveying of the recording material P in the direction K. Left and right edges of the fixing film 25 are restricted by flange members (not shown) mounted on longitudinal ends of the heater holder 22, so as not to be displaced in the longitudinal direction of the heater 20. Also, grease is coated on the internal surface of the fixing film 25, in order to reduce a sliding resistance on the heater 20 or the heater holder 22.

The pressure roller 26 is formed by providing an external periphery of a metal core 26*a* with an elastic and heat-resistant releasing layer 26*b* such as of silicone rubber, and forms a fixing nip N with the fixing film 25, by pressing the fixing film 25 to the heater 20 from below by the external periphery of the releasing layer 26*b*. A width (nip width) a of the fixing nip N in the rotating direction of the pressure roller 26 is so selected as to adequately heat and pressurize the toner on the recording material P.

The rotation control means 28 includes a motor 29 rotating the pressure roller 26, and a CPU 30 for controlling the rotation of the motor 29. For the motor 29, there can be employed for example a stepping motor, and it is possible not only to rotate the pressure roller 26 continuously in the direction R26 but also in an intermittent manner, by a predetermined angle each time. Stated differently, it is possible to step advance the recording material P by repeating a rotation and a stopping of the pressure roller 26.

The temperature control means 27 includes a thermistor (temperature detecting element) 21 mounted on a rear side of the heater 20, and a CPU 23 and a triac 24 for controlling the current supply to the heater 20 based on the temperature detected by the thermistor 21.

As explained in the foregoing, the fixing apparatus 11 pinches and conveys the recording material P in the fixing nip N by the rotation of the pressure roller 26 in the direction R26, and heats the toner T on the recording material P by the heater 20. In this operation, the rotation control means 28 controls the rotation of the pressure roller 26 thereby suitably controlling the conveying of the recording material P, and the temperature control means 27 can adequately control the temperature of the heater 20.

Figure 3A:
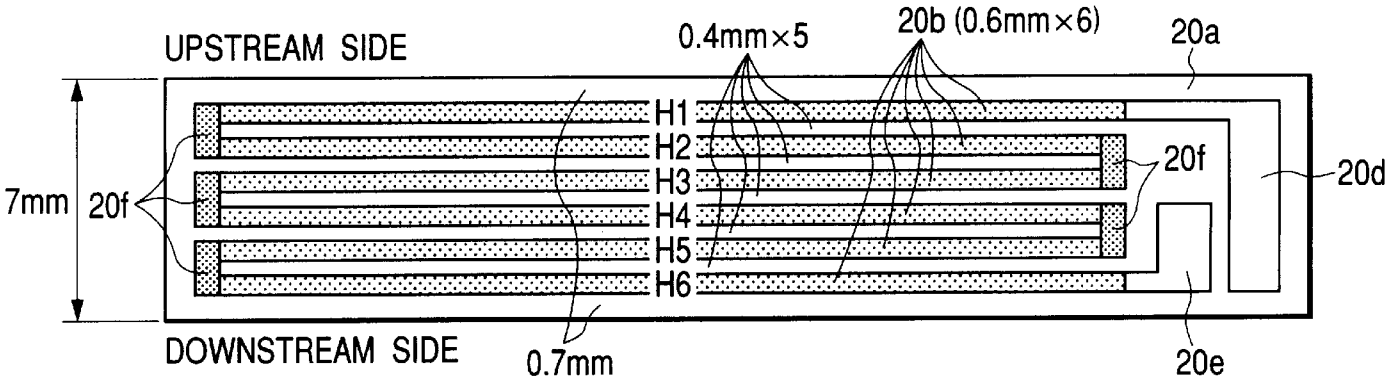
FIGS. 3A and 3B are views showing a configuration of heating member, useful in understanding the present invention and showing a top side of the heating member on which heat generating resistors are serially connected.
Figure 3B:
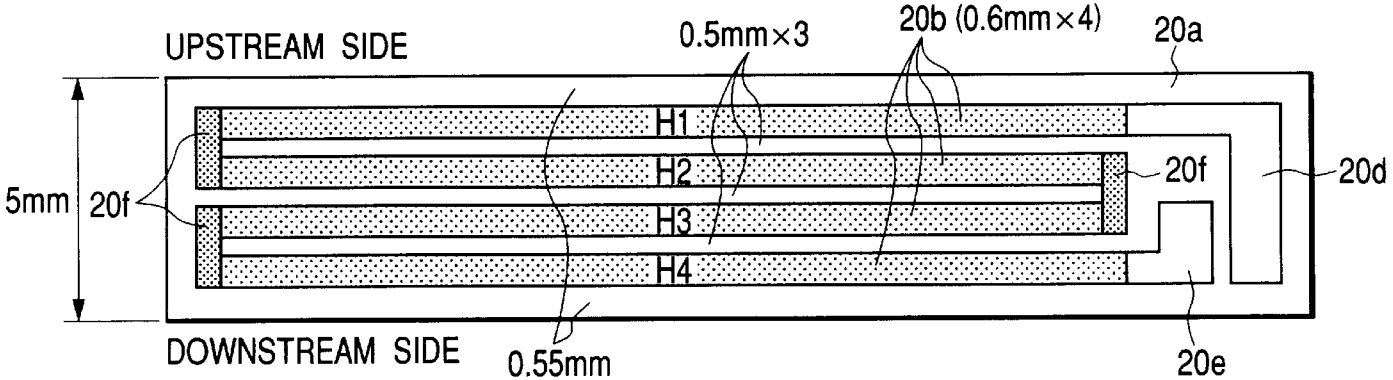

FIGS. 3A and 3B are plan view showing the arrangement of heat generating resistors 20*b* of the heater 20, and useful for the description of the present embodiment.

On a ceramic substrate 20*a* such as of alumina, plural heat generating resistors 20*b* of a thickness of several micrometers to several tens of micrometers are formed by printing and sintering a conductive thick film paste for example of Ag/Pd, utilizing a thick film printing method (screen printing method), and a glass coat layer is printed and sintered thereon utilizing an insulating glass thick film paste (not shown). There are also provided first and second current supply electro patterns 20*d*, 20*e* and a connecting electrode 20*f*. As the past material for the heat generating resistors 20*b* employ very expensive materials such as Ag/Pd, a reduction of the amount of the paste contributes significantly to the cost reduction.

In FIG. 3A, between the first and second current supply electrode patterns 20*d*, 20*e* , the heat generating resistors 20*b* are formed three cycle paths or six units in a serial connection, while, in FIG. 3B, the heat generating resistors 20*b* are formed two cycle paths or four units in a serial connection, and the number of cycle paths of the heat generating resistors 20*b* can be selected in various manners according to the width of the substrate and the width of the heat generating resistor. As will be apparent from the comparison with FIGS. 13A and 13B, the width of each heat generating resistor in the heater in FIG. 3A or 3B is smaller than that of each heat generating resistor in FIG. 13A or 13B. However, the heat generating resistors have a larger number of cycle paths than in the configuration shown in FIG. 13A or 13B, the heat generating resistors are distributed over a wider area of the substrate 20*a*, whereby the distribution of heat generation in the direction of width of the substrate of the heater shown in FIG. 3A or 3B can be made substantially equivalent to that of the heater shown in FIG. 13A or 13B.

Figure 13A:
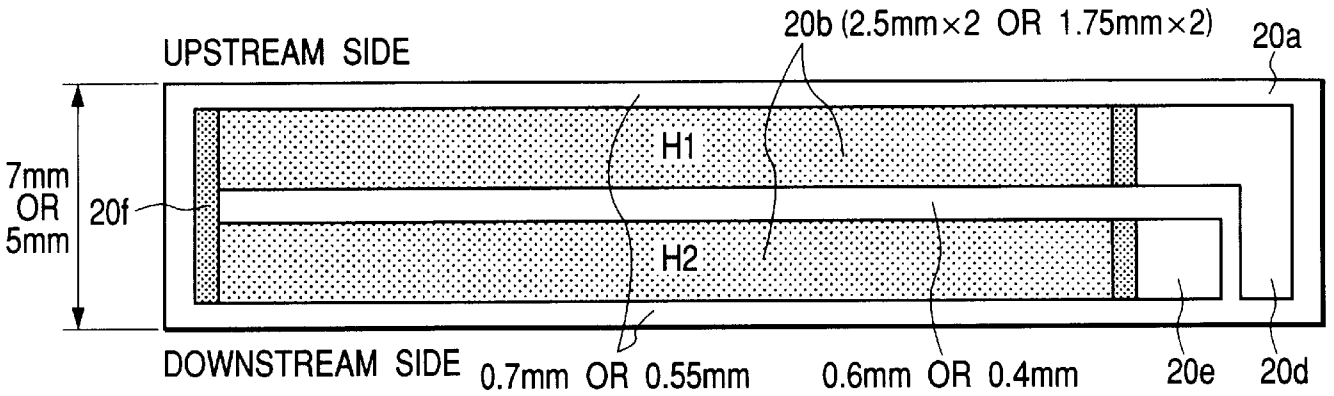
FIGS. 13A and 13B are views showing arrangement of heat generating resistors of heating members of conventional examples.
Figure 13B:
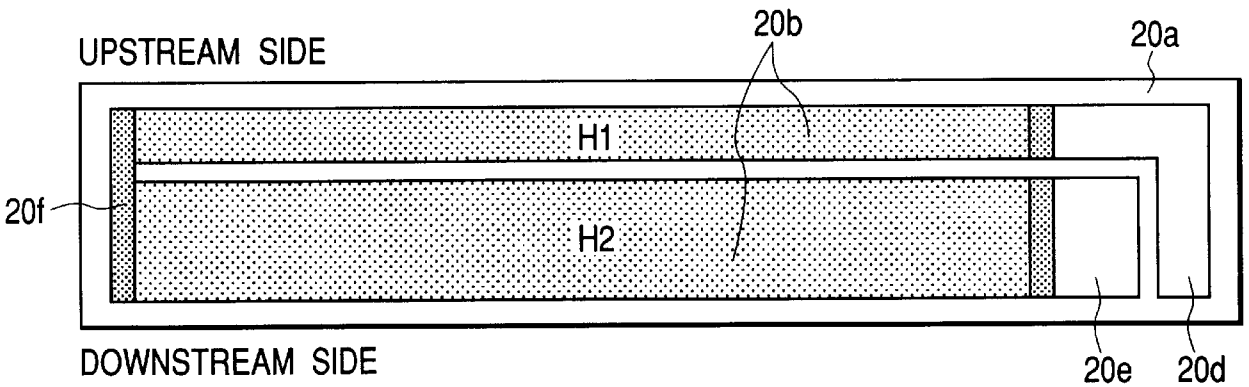

For example, in case the substrate 20*a* has a width of 7 mm and the heat generating resistors are formed excluding end portions of 0.7 mm at the upstream and downstream sides in the conveying direction of the recording material, in the conventional configuration shown in FIGS. 13A and 13B, the heat generating resistors are formed in areas excluding a central area of 0.6 mm, namely with a total width of 5 mm. Also in case the total resistance of the heat generating resistors is selected at 18 Ω (such resistance being selectable in various manners depending on an input voltage or a configuration of the heating apparatus), in the configuration shown in FIG. 13A, there are employed two resistors of a width of 2.5 mm, wherein H1=H2=2.5 mm (9 Ω). On the other hand, in the configuration of the present embodiment shown in FIG. 3A, there are provided six heat generating resistors of 0.6 mm (3 Ω) each, wherein H1=H2=H3=H4=H5=H6=0.6 mm (3 Ω). Spaces between the heat generating resistors become 0.4 mm×5. Therefore, the heat generating area (distance between the edges of the heat generating resistors) is 5.6 mm which is same as in the conventional configuration, while the total width of the heat generating resistors is 3.6 mm, so that the heat generating resistors can be formed with the paste material of a total width amount of about 70% of that in the conventional configuration. Also in case the total resistance of the heat generating resistors is selected same for the heater shown in FIGS. 13A and 13B and that shown in FIGS. 3A and 3B in order to obtain a same amount of total heat generation, each heat generating resistor is thinner in the configuration shown in FIGS. 3A and 3B than in the configuration shown in FIGS. 13A and 13B, so that the volume resistivity of the heat generating resistor can be made lower (9 Ω×2.5 mm/3 Ω×0.6 mm≅12.5 times). The material for the heat generating resistor contains Ag/Pd as explained in the foregoing, and, for lowering the volume resistivity, it is effective to reduce the content of the expensive Pd. Consequently, in comparison with one cycle path of the wide heat generating resistors in series as shown in FIGS. 13A and 13B, two or more cycle paths of the narrower heat generating resistors in series as shown in FIGS. 3A and 3B allows to reduce the amount of the paste and to use a less expensive paste, thus being very effective for cost reduction.

Also in case the substrate 20*a* has a width of 5 mm and the heat generating resistors are formed excluding end portions of 0.55 mm on both sides, in the conventional configuration shown in FIGS. 13A and 13B, the heat generating resistors are formed in areas excluding a central area of 0.4 mm, namely with a width of 1.75 mm (9 Ω)×2=3.5 mm, but in the present reference example shown in FIG. 3B, the heat generating resistors are formed with 0.6 mm (4.5 Ω)×4=2.4 mm with gaps of 0.5 mm×3, so that the heat generating resistors can be formed with a total width amount of the past of 70% or less of the amount required in the conventional configuration.

Figure 3C:
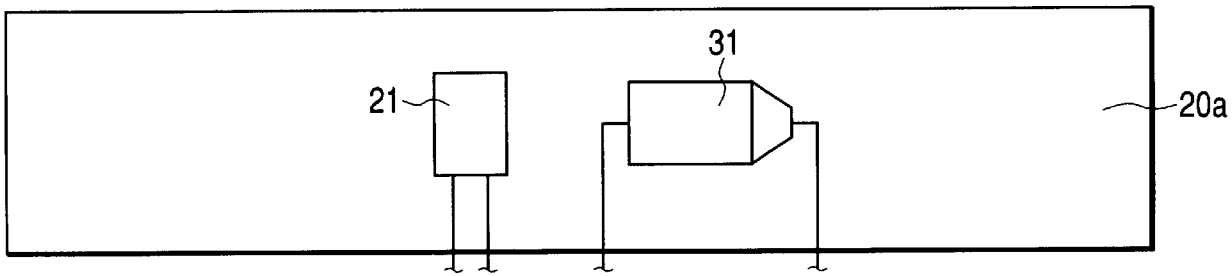
FIG. 3C is a view showing a rear side of the heating member.

FIG. 3C shows a rear side of the heating member 20, namely the rear side of the heat substrate 20*a*. At the rear side of the heat substrate 20*a*, a thermistor 21 for temperature control and a temperature fuse 31 constituting a temperature detecting element for safety, are positioned in contact with the rear surface of the heater substrate or in proximity thereto.

Figure 4A:
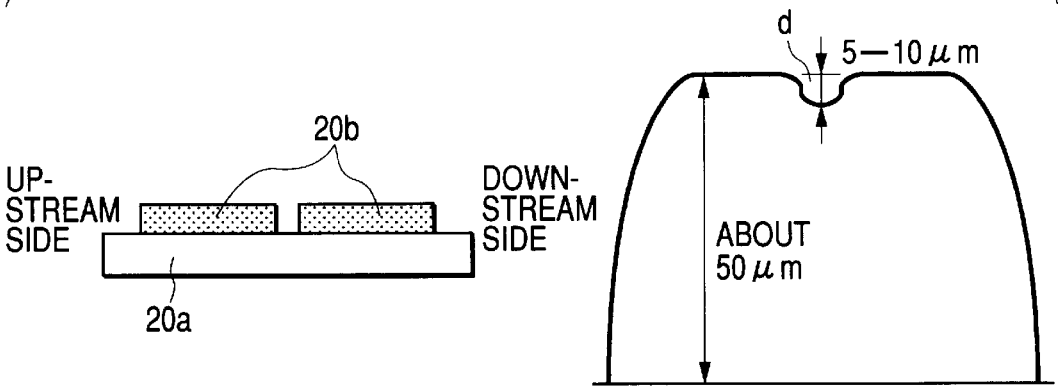
FIGS. 4A, 4B and 4C are views showing a relationship between a pattern of heat generating resistors and a glass surface.
Figure 4B:
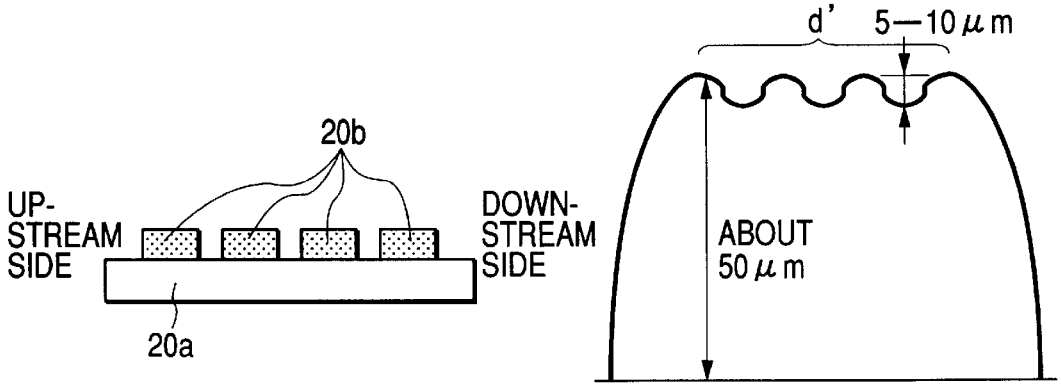
Figure 4C:
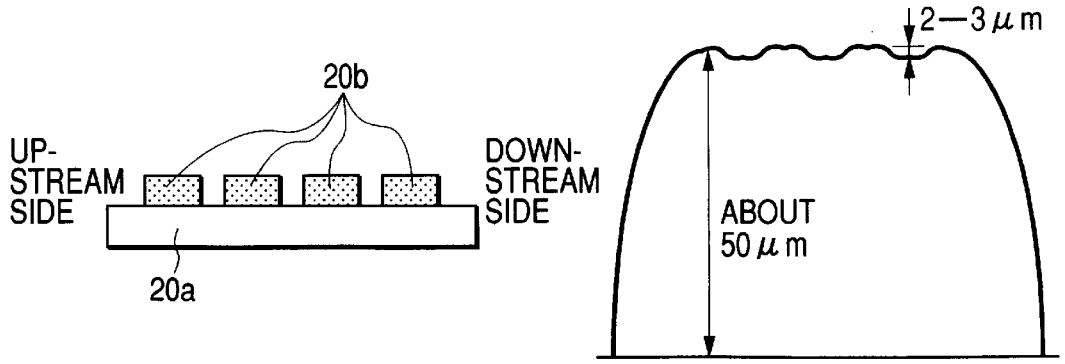

FIGS. 4A, 4B and 4C show a comparison of the surface property of the glass coat layer 20*c* for the heating member 20, in the heater shown in FIG. 13A or 13B and in the heater shown in FIG. 3A or 3B. FIGS. 4A, 4B and 4C show patterns of the heat generating resistors in FIGS. 13A and 13B, wherein the glass coat layer 20*c* is printed and sintered on the substrate so as to cover the pattern of the heat generating resistors with a target thickness of 50 μm. A recess d of a depth of 5 to 10 μm is formed at a gap between the heat generating resistors, but, because the heat generating resistor 20*b* has a large width, a flat area exists in a wide range so that the heat transmitting efficiency is not deteriorated within the nip. However, when the width of each heat generating resistor 20*b* is made smaller as shown in FIG. 4B, an irregularity d' of a depth of about 5 to 10 μm is formed on the surface of the glass coat layer 20*c*, whereby the heat efficiency is somewhat deteriorated. Therefore, the heat efficiency is maintained and improved by securing the surface property of the glass as shown in FIG. 4C, by printing the glass coat layer 20*c* in a pattern opposite to the pattern of the heat generating pattern (among several glass coatings, one or two coatings are printed only in recessed portions in the irregularities where the heat generating resistors are not printed, thereby obtaining a substantially flat glass surface), or by raising the sintering temperature of the glass coat layer 20*c* (the glass coat being sufficiently liquefied to flatten out the surface irregularities formed by the heat generating resistors).

Figure 5:
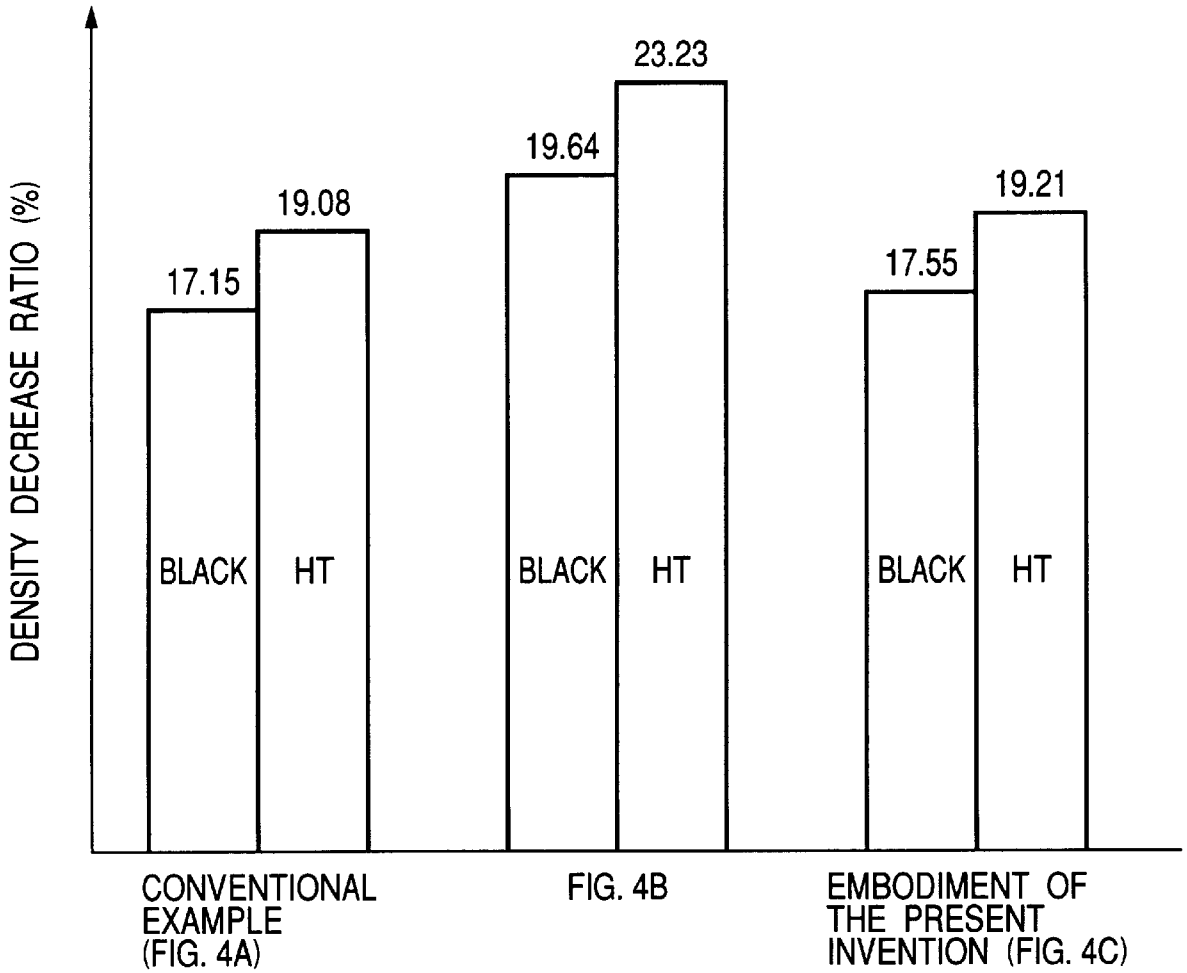
FIG. 5 is a chart showing a comparison of fixing properties of the heating members shown in FIGS. 4A, 4B and 4C.

FIG. 5 shows a comparison of the fixing property among a conventional configuration shown in FIG. 4A, a configuration shown in FIG. 4B in which the heat generating resistor are made thinner and formed in a number of cycle paths while the glass coat layer thereon is not particularly modified, and a configuration of FIG. 4C of the present reference example. A density decrease rate (%) in FIG. 5 indicates a rate of decrease of the density when the image after fixation is rubbed. Thus the fixing property (heat efficiency) is better for a lower density decrease rate. FIG. 5 shows a comparison of the density decrease rate in a "black" image and a "halftone (HT)" image. In comparison with the conventional configuration shown in FIG. 4A, the configuration shown in FIG. 4B shows a somewhat deterioration of the fixing property. On the other hand, the configuration of the present embodiment with an improved glass surface as shown in FIG. 4C secures a fixing property comparable to that of the conventional configuration. It is therefore preferred to print and sinter the glass according to the pattern of the heat generating resistors, thereby optimizing the surface property.

In the following, there will be explained a first embodiment of the present invention. In the first embodiment of the present invention, as shown in FIGS. 6A and 6B, plural heat generating resistors are connected in parallel to a current supply electrode (20*e* or 20*d*).

In the printing operation of the pattern of the heat generating resistor on the heat substrate 20*a*, the width of the heat generating resistor may somewhat fluctuate for example by a tolerance in the manufacture. A width different from a design value naturally results in a resistance different from the designed value, so that the desired heat amount cannot be obtained. Such heater is unusable and the production yield is deteriorated. For example, in a heater in which all the plural heat generating resistors are connected serially as shown in FIGS. 3A, 3B, 13A or 13B, the serially connected heat generating resistors show a large fluctuation in the entire resistance if the width is different from the design value even in a single resistor.

Figure 6A:
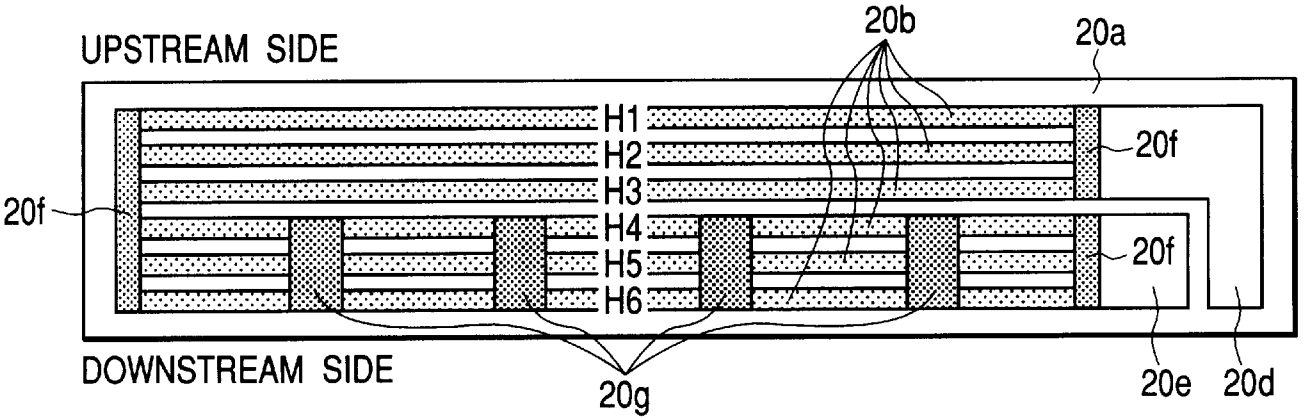
FIGS. 6A and 6B are plan views of the heating member of a first embodiment, in which plural heat generating resistors are connected in parallel to each current supply electrode.
Figure 6B:
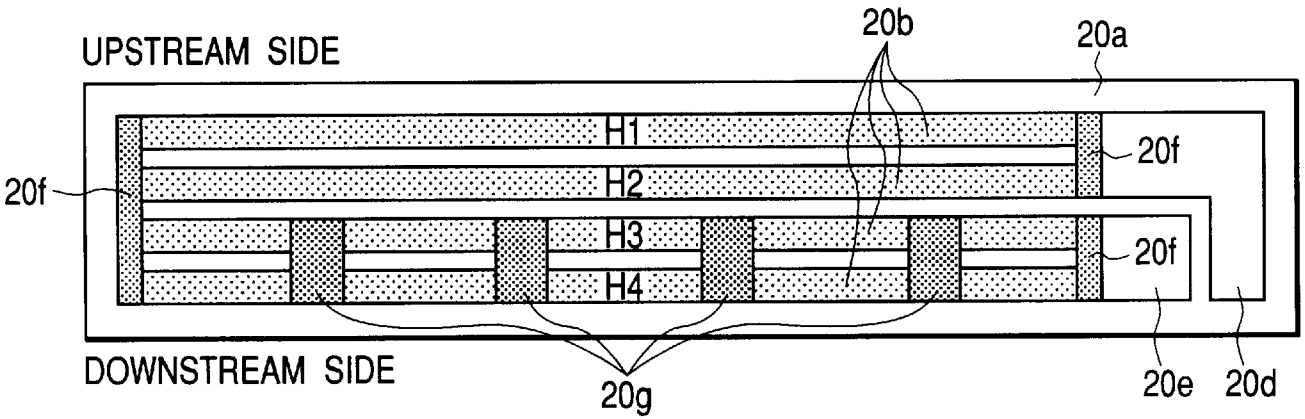

On the other hand, in case plural heat generating resistors are connected in parallel to a current supply electrode as shown in FIG. 6A or 6B, even if one of the parallel heat generating resistors is different in the width from the design value, the fluctuation of the entire resistance of the heat generating resistors can be made smaller than that in the case where all the heat generating resistors are connected serially. Also in the configuration shown in FIG. 6A or 6B, the heat generating resistors (H, H2, H3, H4, H5, H6) have a same heat generating amount. Therefore, the production yield of the heater can improved in comparison with the connecting method shown in FIG. 3A or 3B, or FIG. 13A or 13B. Also, even in case a heat generating resistor 20*b* is formed extremely thin, the current to such extremely thin portion of the heat generating resistor can be reduced to suppress a local heat generation. Since it is conceivable that the management of the resistance of the heat generating resistor 20*b* becomes difficult in case the width of the heat generating resistor is made smaller as a result of smaller width of the substrate, a parallel connection is more advantageous. Also in case of a parallel connection, it is easily possible to obtain a uniform distribution of heat generation (or resistance) even with finer heat generating resistors, by forming latter-shaped heat generating resistors 20*g* along the conveying direction of the recording material, with a pitch of several tens of millimeters. Also such ladder-shaped portions allows to manage a partial resistance, in the resistance management of the heat generating resistors, without executing resistance measurements on all the heat generating resistors. However, the ladder-shaped portion shows a somewhat lower amount of heat generation, so that such portion preferably does not coincide with the position of the temperature detecting element (thermistor) or the safety temperature detecting element (temperature fuse).

In the heating member 20 to be employed in the fixing apparatus 11 of the present embodiment, as in the heater shown in FIGS. 3A, 3B and 3C, the amount of use of the paste material for the heat generating resistor can be reduced to 70% or less, in comparison with the heater shown in FIGS. 13A and 13B, and such paste material itself can be made less expensive. The coat layer to be provided on the heat generating resistors can be an ordinary one, but it is more preferable to fill the gaps between the heat generating resistors as shown in FIG. 4C, thereby suppressing the loss of the heat transmission efficiency to the recording material.

Second Embodiment

Figure 7A:
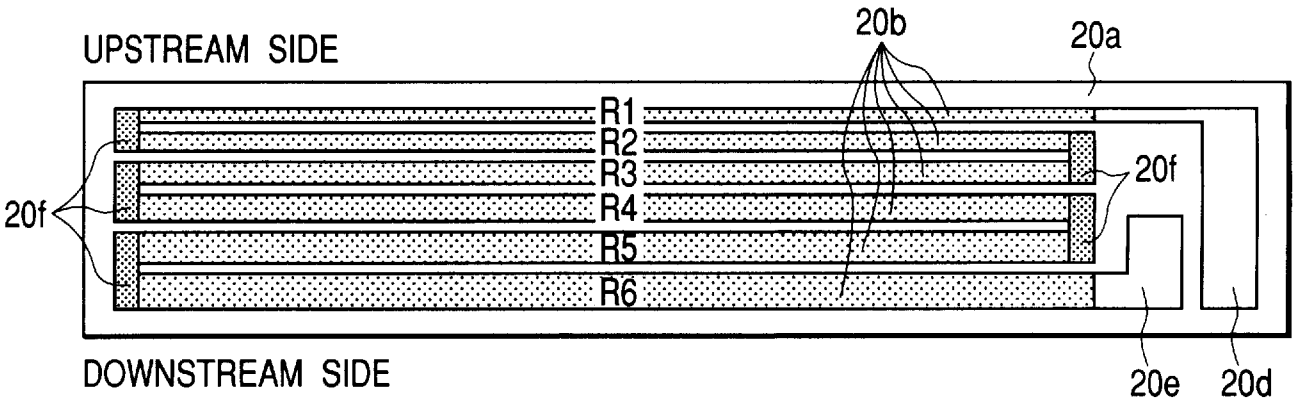
FIGS. 7A and 7B are plan views of the heating member of a second embodiment, in which plural heat generating resistors of different widths are connected in series in two or more cycle paths.

The foregoing first embodiment has a same amount of heat generation in the upstream and downstream sides of the heater substrate 20*a* in the conveying direction of the recording material, but, in the present embodiment, the resistances of the heat generating resistors are varied as shown in FIGS. 7A and 7C to modulate the amounts of heat generation in the upstream and downstream sides, thereby optimizing the distribution of heat generation by the heat generating resistors.

Figure 7B:
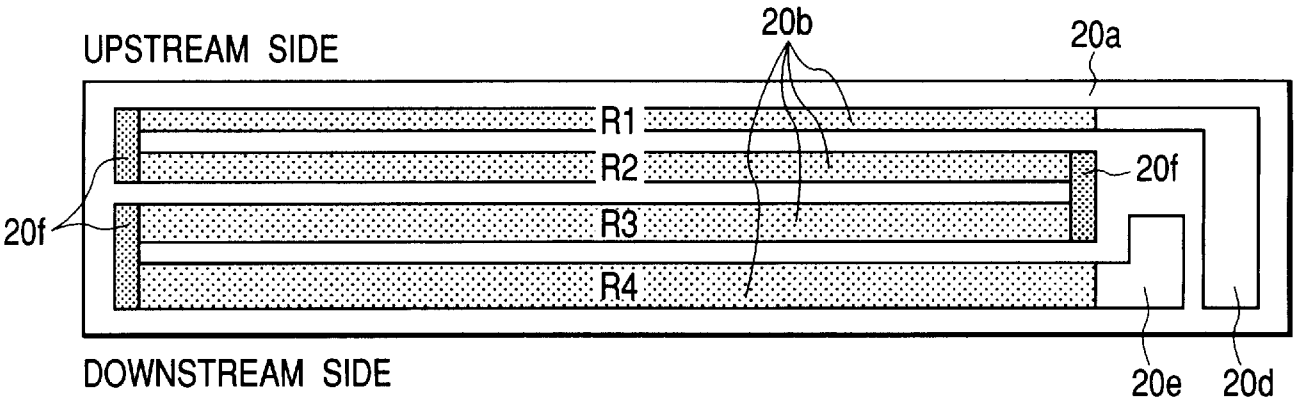

In FIGS. 7A and 7B, all the heat generating resistors are connected serially, and the resistances R1, R2, R3, R4, R5 and R6 in FIG. 7A or R1, R2, R3 and R4 in FIG. 7B of the heat generating resistors in succession from the upstream side are gradually reduced from the upstream side to the downstream side (heat generating resistor becoming wider toward the downstream side). Thus, in FIG. 7A or 7B, there stands a relation (upstream resistance)>(downstream resistance). Thus, in FIG. 7A, there stands a relationship R1>R2>R3>R4>R5>R6, and in FIG. 7B, there stands a relationship R1>R2>R3>R4.

In the conventional configuration, there are selected conditions of H1=1.7 mm (12 Ω) and H2=3.3 mm (6 Ω), but there results an abrupt temperature change in the conveying direction of the recording material because the heat generating resistors are formed in a single cycle path. In FIG. 7A, the heat generating resistors are provided in at least two cycle paths for gradually changing the amount of heat generation (with a smaller resistance toward the downstream side; for example in the configuration shown in FIG. 7A, there are selected conditions of R1=0.36 mm (4.2 Ω), R2=0.41 mm (3.7 Ω), R3=0.48 mm (3.2 Ω), R4=0.57 mm (2.7 Ω), R5=0.7 mm (2.2 Ω), and R6=0.9 mm (1.7 Ω), with a total width of the heat generating resistors of about 3.4 mm and a total resistance of about 18 Ω), thereby obtaining a smooth temperature distribution in the conveying direction of the recording material. Also the amount of heat generation is made larger in the upstream side to generate a thermal stress opposite to a stress toward the downstream side, generated by the passing of the recording material or the movement of the fixing film, thereby preventing destruction of the heater substrate. Also, even if a heat transfer toward the downstream side is caused by the passing of the recording material or by the movement of the fixing film, a uniform heat distribution can be maintained within the nip thereby enabling appropriate heating of the recording material.

Figure 8A:
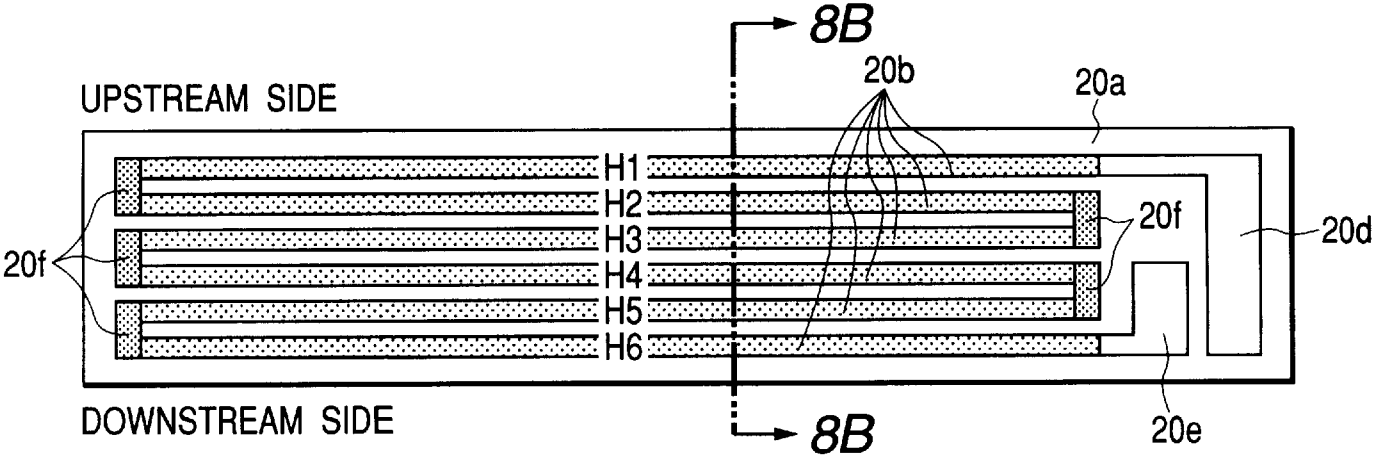
FIG. 8A is a plan view showing a variation of the second embodiment, in which plural heat generating resistors with different print thicknesses are connected in series in two or more cycle paths.
Figure 8B:
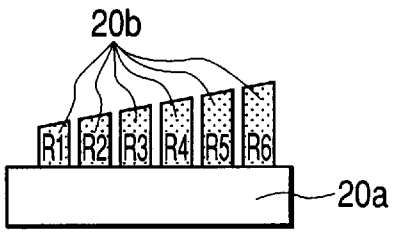
FIG. 8B is a cross-sectional view along a line 8B—8B in FIG. 8A.

In the configuration shown in FIG. 7A or 7B, the resistance is varied by the width of the heat generating resistor 20*b*, but it is also possible to control the resistance by the thickness of the heat generating resistor 20*b* as shown in FIG. 8A or 8B. FIG. 8B is a cross sectional view along a line 8B—8B in FIG. 8A. It is furthermore possible to vary the resistance by the paste material for the heat generating resistor. Also in this case, the resistance is made smaller from the upstream side to the downstream side (heat generating resistor being thicker toward the downstream side). Thus, also in FIG. 8A, there stands a relation (upstream resistance)>(downstream resistance). Thus, in FIG. 8A, there stands a relationship R1>R2>R3>R4>R5>R6.

Figure 9:
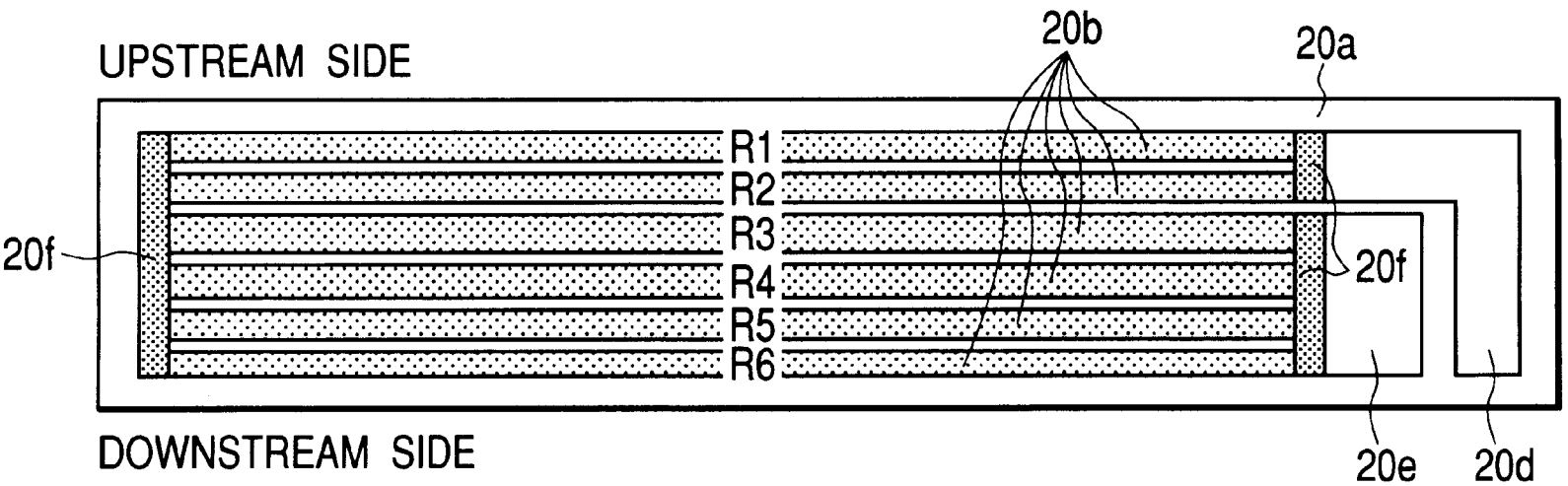
FIG. 9 is a plan view of a heating member constituting still another variation of the second embodiment.

FIG. 9 shows a case where heat generating resistors 20*b* are connected in parallel. The resistor pattern shown in FIG. 9 has one cycle path, but plural heat generating resistors are connected in parallel to a current supply electrode both in the forward path (R1, R2) and in the return path (R3 to R6). In case of FIG. 9, in order to increase the amount of heat generation in the upstream side, the resistances R1, R2, R3, R4, R5, R6 of the heat generating resistors from the upstream side are so selected as to satisfy a condition: forward (upstream) resistance>return (downstream) resistance. More specifically, resistances are so selected as to satisfy a following relation:

$$\frac{(R1\times R2)}{(R2+R1)} > \frac{R3\times R4\times R5\times R6}{R4\times R5\times R6+R3\times R5\times R6+R3\times R4\times R6+R3\times R4\times R5}$$

and $$R3<R4<R5<R6.$$

In the configuration shown in FIG. 9, the heat generating resistors are selected with conditions of R1=0.4 mm (24 Ω), R2=0.4 mm (24 Ω), R3=0.6 mm (16 Ω), R4=0.5 mm (19 Ω), R5=0.4 mm (24 Ω), and R6=0.3 mm (32 Ω), with a total width of the heat generating resistors of about 2.6 mm (with a gap of about 0.6 mm between the heat generating resistors, thereby achieving about ½ of the total width 5 mm in the conventional configuration) and a total resistance of about 18 Ω.

In FIG. 9, the resistance is controlled by the width of the heat generating resistors, but it may also be controlled by the thickness or the material. Also there may be provided ladder-shaped heat generating resistors shown in FIGS. 6A and 6B to achieve a uniform distribution of heat generation (resistance distribution).

Figure 10A:
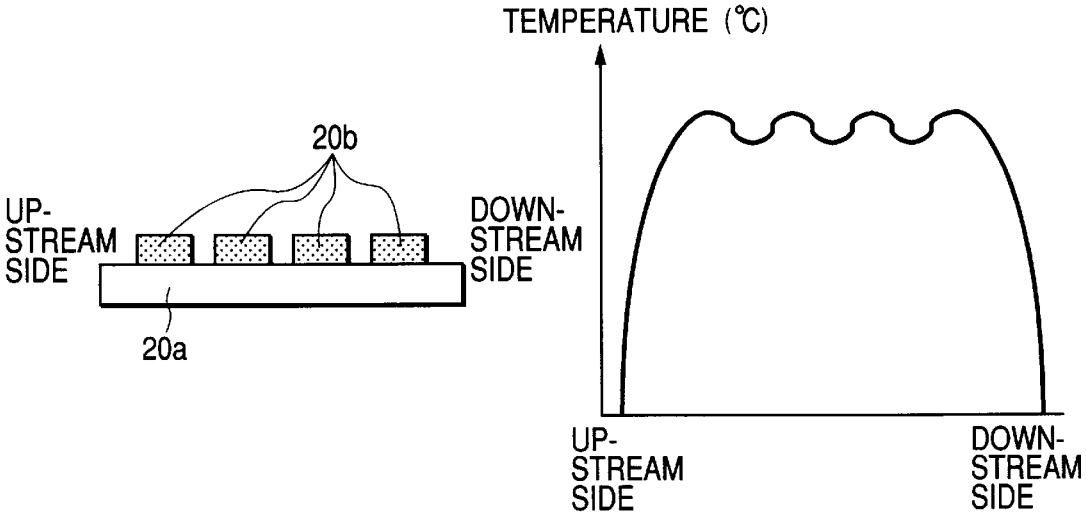
FIG. 10A is a view showing a generated heat distribution of the heating member of the first embodiment.
Figure 10B:
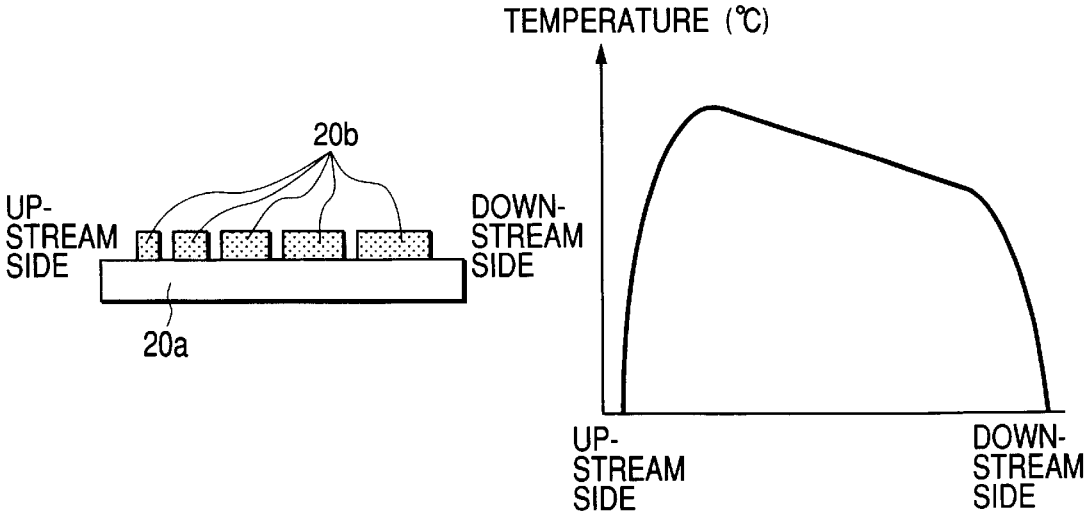
FIG. 10B is a view showing a generated heat distribution of the heating member of the second embodiment.

FIGS. 10A and 10B show a distribution of heat generation on the surface of the heating member of the first embodiment and the present embodiment immediately after the power supply is turned on. In the first embodiment, only immediately after the start of the power supply, there results a distribution of heat generation as shown in FIG. 10A or 10B by the temperature increase in the heat generating resistors, but, by maintaining the gap of the heat generating resistors at 0.7 mm or less as in the present embodiment, there can be realized a smooth distribution of heat generation, and it is also possible to obtain a smooth distribution as shown in FIG. 10A or 10B even in case the amount of heat generation is made larger in the upstream side.

Thus an exact control is rendered possible even in case the thermistor 21 (FIG. 3A or 3B) for temperature control or the temperature fuse 31 (FIG. 3A or 3B) constituting the safety temperature detecting element is displaced in the direction of the width of the heating member by a tolerance or a failure in the manufacture. Also, since an appropriate temperature distribution can be maintained to avoid an image defect, a failure in a prolonged running test or an abrupt change in the temperature distribution, it is possible to relax the standard for the heat distribution or for the resistance distribution, so that the heater of a lower cost can be provided.

Third Embodiment

Figure 11A:
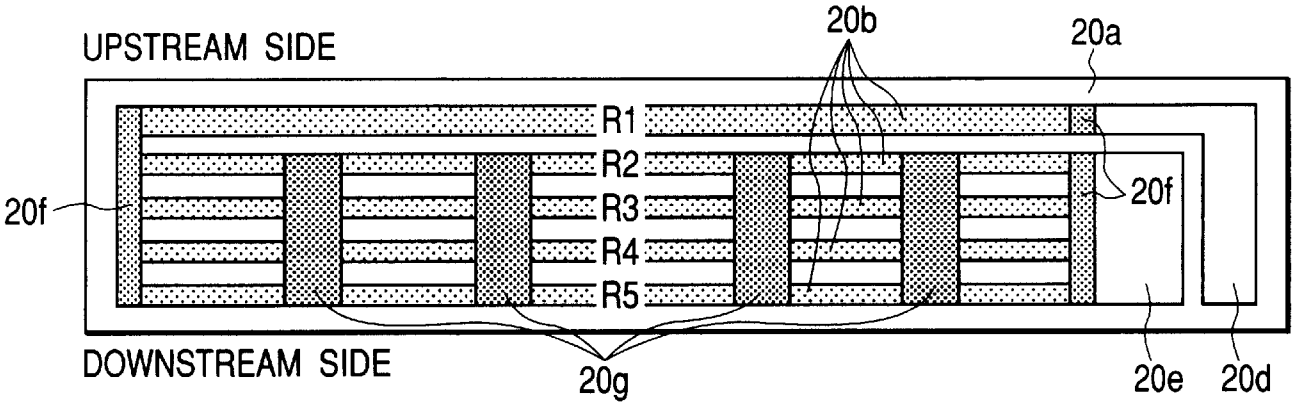
FIGS. 11A and 11B are plan views of a heating member constituting a third embodiment.
Figure 11B:
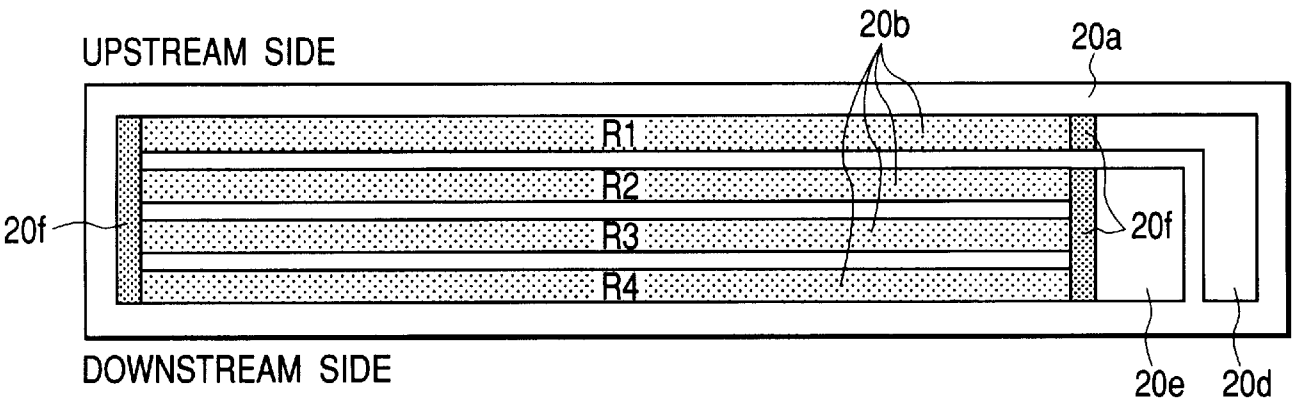
Figure 12:
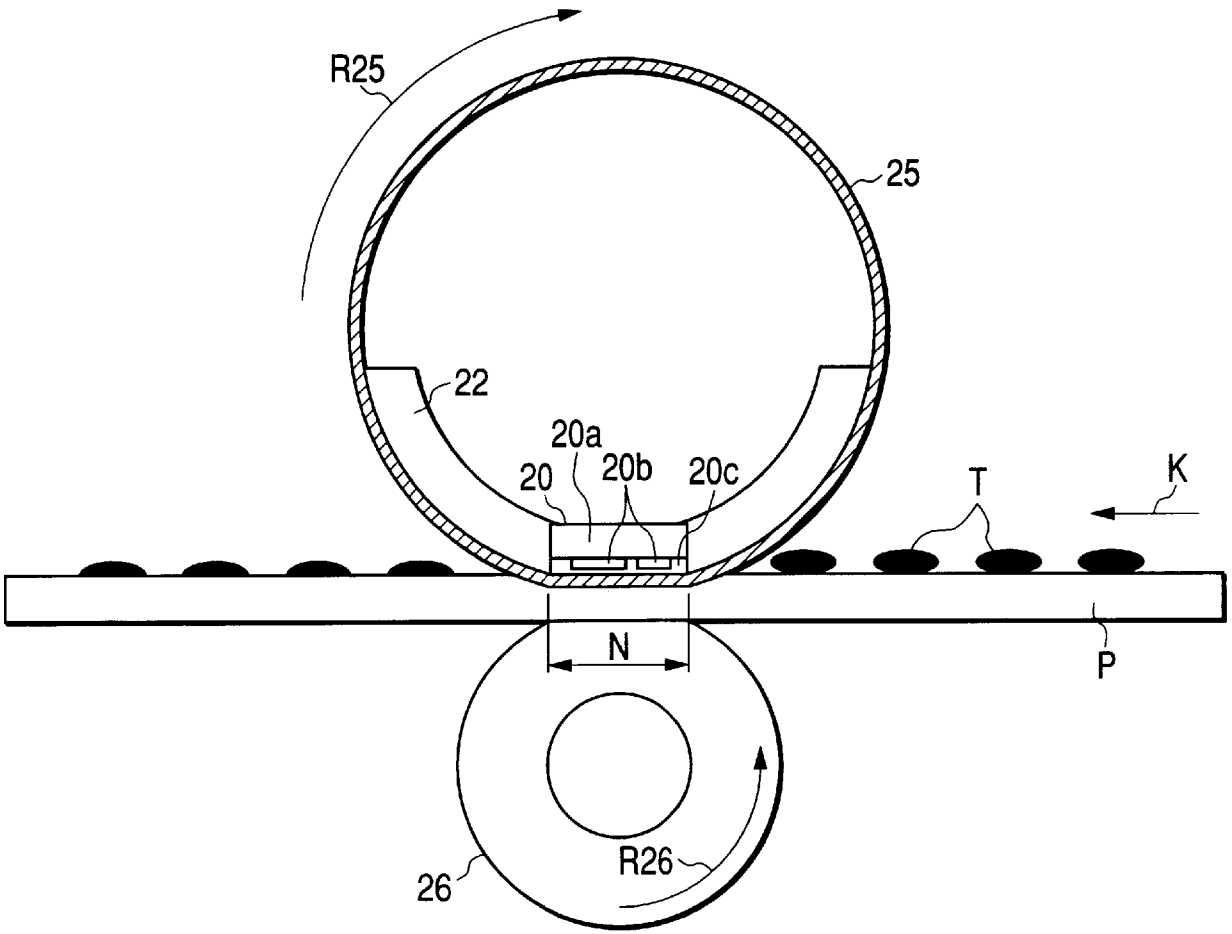
FIG. 12 is a vertical cross-sectional view showing a schematic configuration of a fixing apparatus of a conventional example.

In the present embodiment, as shown in FIG. 11A or 11B, the forward (upstream) heat generating resistor is formed by a single resistor (one heat generating resistor being connected to the current supply electrode 20*d*), while the return (downstream) heat generating resistor is gapped in the longitudinal direction (plural heat generating resistors being connected to the current supply electrode 20*e*). One of the objects of such configuration is, even in case the safety temperature detecting element fails to function, to destruct the heater in a specified position, thereby preventing a current leakage and avoiding an erroneous operation of a communicating computer or an accident to the user resulting from such current leakage. In such error state, it is possible to induce a convex deformation of the substrate toward the upstream side by a thermal stress therein, thereby cutting off the heat generating resistor at the upstream side and to terminate the current supply.

However, in case plural heat generating resistors are present at the upstream side as in the first or second embodiment, the breakage of a resistor causes a concentration of the current to the remaining resistors, thereby causing an abrupt heating. Such situation induces a heat distribution different from the intended one, thus destructing the heater substrate and eventually involving plural spark generations.

The present embodiment employs a single heat generating resistor at the upstream side and also selects the amount of heat generation in the forward (upstream) side within a range from twice to three times of that of the return (downstream) side, thereby cutting off the heat generating resistor of the upstream side in a failure state, thereby terminating the power supply without the danger of spark generation etc.

In the present embodiment, the resistances of the heat generating resistors are so selected as to satisfy a relation: 3× return (downstream) resistance≧forward (upstream) resistance≧2× return (downstream) resistance. More specifically:

$$\frac{3\times R2\times R3\times R4\times R5}{R3\times R4\times R5+R2\times R4\times R5+R2\times R3\times R5+R2\times R3\times R4}$$

$$\geq R1 \geq$$

$$\frac{2\times R2\times R3\times R4\times R5}{R3\times R4\times R5+R2\times R4\times R5+R2\times R3\times R5+R2\times R3\times R4}$$

In FIG. 11A, for example with the heat generating resistors of R1=1 mm (12 Ω) and R2=R3=R4=R5=0.525 mm (23 Ω), there can be obtained a downstream resistance of about 5.75 Ω, satisfying a relationship 5.75 Ω×3=17.25 Ω≧upstream resistance 12 Ω≧5.75 Ω×2=11.5 Ω, and providing a heat generating resistor of a total width of about 3.1 mm and a total resistance of about 18 Ω.

Such resistances allow to securely disconnect the heat generating resistor RI in a failure state, thereby suspending the failure.

A failure test was executed with a fixing apparatus employing the heating member of the present embodiment and that employing the heating member of the second embodiment. Assuming a failure in the temperature detecting element and in the safety element, a maximum power of 139.7 V (in 100 V system) was charged into the heating member. In the heating member of the second embodiment, the heater holder 22 and the pressure roller 26 were fused, and the heating member was destructed with plural spark generations after about 5 seconds. In the present embodiment, the heat generating resistor in the upstream part of the heating member was cut off by the thermal stress thereof after about 4 seconds, whereby the failure was stopped without spark generation.

The present embodiment allows to provide a heating apparatus and an image forming apparatus which are safer and lower in cost.

Others

1) The configuration of the heating apparatus of the film heating type is not limited to that in the foregoing embodiments but can be arbitrarily selected.

2) The elastic member constituting the pressurizing member is not limited to a roller member. It may also be formed by a rotationally driven belt member, and such member can also be heated by a heat source.

3) The heating apparatus of the present invention is applicable not only to a fixing apparatus but also to an image heating apparatus for temporary image fixation, an image heating apparatus for re-heating an image-bearing recording medium for improving the surface property such as surface gloss, or a heating apparatus for heating a sheet-shaped member other than the recording medium for the purpose of drying, laminating, crease elimination by hot pressing or decurling by hot pressing.

The present invention is not limited to the foregoing embodiments, but includes any and all modifications within the technical scope of the invention.

What is claimed is:

1. A heater comprising:

a substrate;

heat generating resistors formed at least in a cycle path including a forward path and a return path on said substrate; and current supply electrodes provided at electrical ends of said heat generating resistors;

wherein plural heat generating resistors are connected in parallel to at least one of said current supply electrodes.

2. A heater according to claim 1, wherein, in both the forward path and the return path of said heat generating resistor, a plurality of said heat generating resistors are connected in parallel to said current supply electrode.

3. A heater according to claim 1, wherein a plurality of said heat generating resistors are connected in parallel to one of said current supply electrodes, and a heat generating resistor is connected to the other of said current supply electrodes.

4. A heater according to claim 1, wherein said plural heat generating resistors connected in parallel are electrically connected in plural positions in the longitudinal direction of said substrate.

5. A heater according to claim 1, further comprising a surface layer on said heat generating resistors, wherein said surface layer fills in gaps between said heat generating resistors to improve an irregularity.

6. A heater according to claim 1, wherein said plural heat generating resistors have respectively different resistances.

7. An image heating apparatus for heating an image formed on a recording material, comprising:

a heater, including a substrate, heat generating resistors formed at least in a cycle path including a forward path and a return path on said substrate, and current supply electrodes provided at electrical ends of said heat generating resistors; and a flexible sleeve rotating in sliding contact with said heater;

wherein a plurality of said heat generating resistors are connected in parallel to at least one of said current supply electrodes.

8. An image heating apparatus according to claim 7, wherein, in both the forward path and the return path of said heat generating resistor, a plurality of said heat generating resistors are connected in parallel to said current supply electrode.

9. An image heating apparatus according to claim 7, wherein a plurality of said heat generating resistors are connected in parallel to one of said current supply electrodes, and a heat generating resistor is connected to the other of said current supply electrodes.

10. An image heating apparatus according to claim 9, wherein said current supply electrode to which a heat generating resistor is connected is an electrode at an upstream side in the moving direction of the recording material.

11. An image heating apparatus according to claim 7, wherein said plural heat generating resistors connected in parallel are electrically connected in plural positions in the longitudinal direction of said substrate.

12. An image heating apparatus according to claim 7, further comprising a surface layer on said heat generating resistors, wherein said surface layer fills in gaps between said heat generating resistors to improve an irregularity.

13. An image heating apparatus according to claim 7, wherein said plural heat generating resistors have respectively different resistances.

* * * * *

UNITED STATES PATENT AND TRADEMARK OFFICE

CERTIFICATE OF CORRECTION

PATENT NO. : 6,734,397 B2
DATED : May 11, 2004
INVENTOR(S) : Akira Kato et al.

It is certified that error appears in the above-identified patent and that said Letters Patent is hereby corrected as shown below:

Column 7,
Line 2, “20e ,” should read -- 20e, --.
Lines 39 and 45, “same” should read -- the same --.

Column 10,
Line 40, “cross sectional” should read -- cross-sectional --.

Signed and Sealed this

Twenty-fourth Day of August, 2004

JON W. DUDAS
*Director of the United States Patent and Trademark Office*